US006164848A

United States Patent [19]

Coufal

[11] Patent Number: 6,164,848

[45] **Date of Patent: *Dec. 26, 2000**

[54] PROCESS AND CIRCUIT FOR PRINTING A PRINT IMAGE

[75] Inventor: Georg Coufal, Markt Schwaben, Germany

[73] Assignee: Oce Printing Systems GmbH, Poing, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/155,369

[22] PCT Filed: Mar. 26, 1997

[86] PCT No.: PCT/DE97/00642

§ 371 Date: Apr. 12, 1999

§ 102(e) Date: Apr. 12, 1999

[87] PCT Pub. No.: WO97/36211

PCT Pub. Date: Oct. 2, 1997

[30] Foreign Application Priority Data

Mar. 27, 1996 [DE] Germany ..... 196 12 176

[51] Int. Cl.[7] ..... B41J 11/44

[52] U.S. Cl. ..... 400/76; 400/70; 400/61; 400/579; 400/582; 226/31

[58] Field of Search ..... 400/76, 70, 61, 400/74, 579, 582; 101/481, 484, 485; 226/30, 31

[56] References Cited

U.S. PATENT DOCUMENTS

| | | | |
|---|---|---|---|
| 3,808,971 | 5/1974 | Staamann | 101/181 |
| 4,684,276 | 8/1987 | Frei et al. . | |
| 4,949,104 | 8/1990 | Negoro et al. . | |
| 5,779,124 | 7/1998 | Akira | 226/2 |
| 5,809,390 | 9/1998 | Jackson | 399/384 |
| 5,820,007 | 10/1998 | Crowley | 226/31 |
| 5,839,688 | 11/1998 | Hertel et al. | 242/523.1 |

FOREIGN PATENT DOCUMENTS

| | | |
|---|---|---|
| 38 17 146 A1 | 12/1988 | Germany . |
| 57-174288 | 10/1982 | Japan . |
| WO 96/14261 | 5/1996 | WIPO . |

OTHER PUBLICATIONS

Japanese Abstract, 01025163, Jan. 27, 1989.
Japanese Abstract, 06099638, Dec. 4, 1994.
Japanese Abstract, 55–164180, Dec. 20, 1980.
Japanese Abstract, 57–174288, Oct. 26, 1982.
Japanese Abstract, 5–155080, Jun. 22, 1993.
British Library Cataloguing in Publication Data, "Closed–loop control".

*Primary Examiner*—John S. Hilten
*Assistant Examiner*—Charles H. Nolan, Jr.
*Attorney, Agent, or Firm*—Schiff Hardin & Waite

[57] ABSTRACT

A process is described for printing a print image on a continuous support material relative to a pre-set position in an electrophotographic printer in which a stepper motor controlled by an electric impulse sequence drives a transport device.

7 Claims, 6 Drawing Sheets s1=V*t1 s2=V*t2 s3=V*t3

$f_{SIF}$ / Hz
{$f_{CLOCK}$=1 MHz}
$f_{CLOCK}$=10 MHz
[$f_{CLOCK}$=100 MHz]
102
9000
8000
7000
6000
5000
4000
3000
2000
1000
0
I, IV
II, III
104
106
P1
P1'
P2
P2'
100
0
{100} 1000 [10000]
{200} 2000 [20000]
{300} 3000 [30000]
{400} 4000 [40000]
{500} 5000 [50000]
{600} 6000 [60000]
DIVIDER VALUE (TW)

PROCESS AND CIRCUIT FOR PRINTING A PRINT IMAGE

BACKGROUND OF THE INVENTION

1. Field of the Invention

Method and circuit arrangement for printing a print image.

The present invention relates to a method for printing a print image on an endless stock in relation to a predetermined position in an electrographic printer.

2. Description of the Related Art

Electrographic printers are known in which a motor drives a transport means that transports the stock past a transfer printing station, essentially according to a predetermined print speed. During the printing process, print images produced by a printing control unit are printed successively on the stock at the transfer printing station with the print speed. If the transport means communicates a forward motion to the stock by means of positive locking, as is for example the case given the engagement of transport pins in transport holes of a stock perforated in the edge regions, then within determinate limits a constrained movement is realized between the stock and the transport means.

If, however, the transport means communicates the forward motion to the stock by means of non-positive locking, in that a rubberized transport roller or a transport strip stands in non-positive contact with the stock, a constrained movement between the stock and the transport roller or, respectively, transport strip is prevented by various influencing factors. These influencing factors include the microslippage that occurs in that the non-positive connection between the drive roller and the stock so that alignment is not one hundred percent guaranteed. Another influencing factor is to be found in the mechanical tolerances in the manufacture of the drive roller and its mounting in the transport means. A constrained movement between the stock and the drive roller thus does not take place. Since the transport speed of the stock thus never agrees entirely with the speed of the drive roller, a synchronous operation between the stock and the print process is excluded. If, for example, pre-printed form material, applied using offset printing, is present on the stock, in which numbers or letters are supposed to be printed in predetermined form fields during the print process, an offset, due to the minimal speed difference, between the letters and the form fields becomes larger with each printed form. An interruption of the print process in order to correct the offset is unavoidable.

However, the cited problems with respect to the offset also occur when the transport means communicates the forward motion in positively locked fashion to the stock. In this case, a clock generator is fastened to a photoconductor drum in the transfer printing station, which clock generator, via a control circuit for the phase (PLL—phase locked loop) generates the frequency of a stepped motor for driving the transport means, and for an illumination row for the illumination of the photoconductor drum. A disadvantage of this solution is that mechanical stiffnesses, network frequency oscillations, etc., are not completely corrected. Moreover, more complex electronic components are required for the realization of the phase controlling, which mostly operate according to an analog design, i.e. process continuous voltage values.

The object of the invention is to indicate a simple digital solution for printing endless stock that enables an offset-free printing in relation to a predetermined position.

This object is solved by means of a method having the features of patent claim 1. The invention proceeds from the assumption that given essentially constant transport speed of the stock, the offset becomes cumulatively larger from print image to print image. Accordingly, in order to correct the offset, only minimal speed modifications of the transport speed of the stock are necessary. The transport speed can accordingly be used as a reference quantity for a measurement of the offset, despite slight fluctuations.

In the invention, markings are present on the stock at regular intervals, for the positioning of the print images in the direction of transport. At the beginning of the printing of a print image, a print image beginning signal is produced by the print control unit. Given offset-free printing, the markings must always be at the same locations in relation to the transfer printing station when the print image beginning signal occurs, due to the equal spacing and the essentially constant transport speed. An offset expresses itself in that the markings change slowly from print image to print image in relation to a selected reference point in the environment of the transfer station, when only momentary registrations are respectively observed at the reference point at the moment of the print image beginning signal.

In the invention, a signal pickup is fastened in stationary fashion relative to the transfer printing station, which pickup produces a marking signal when a marking is detected. Given an offset, markings located before the signal pickup in the direction of transport will move toward the signal pickup or, respectively, move away from it, if successive momentary registrations are observed at times with an active print image beginning signal, according to whether the transport speed of the stock is somewhat greater or somewhat less than the print speed.

Due to the greater or lesser spacing in relation to the signal pickup, the distance of the marking located closest before the signal pickup can be used to measure the offset by measuring the time required for this marking to reach the signal pickup.

For this reason, when the print image beginning signal occurs, a counting process of clock signals is started in a counter. The counting process is interrupted upon the occurrence of the next marking signal at the signal pickup. The count result stands in a ratio that is determined by the clock signals to the time required for the next marking to reach the signal pickup. From this time, by multiplication by the print speed the distance of the marking from the signal pickup at the time of the print image beginning signal can be calculated. In particular, given a change in this distance from print image to print image, an offset can be recognized. In the invention, the counter result is compared with a target value that corresponds to a counter state given an offset-free positioning of the print images in relation to the marking. If the count result is greater than the target value, the frequency of a current impulse sequence that controls a stepped motor that drives the transport means is increased. If the count result is smaller than the target value, the frequency of the current impulse sequence is reduced, so that the marking is again removed from the signal pickup upon the next print image beginning signal.

Both the counter and also the stepped motor controlling can be realized digitally. Since a microprocessor is present in the printer, the comparison can also easily be carried out digitally. In the invention, only one counter and an easily modifiable impulse controlling for the stepped motor need be used for the synchronization of the transport speed of the stock and of the print speed.

As markings, e.g. the transport holes of the stock or a cross-perforation, present if necessary at the beginning and at the end of a print page, can be used, so that no additional expense also arises due to the markings. Given stock that is free of transport holes, an offset-free printing is required only when the stock is already for example printed with pre-printed form material before the printing process. The required additional expense for the application of the markings in offset printing is likewise low, since the markings are applied at the same time as the pre-printed form material.

In an embodiment of the invention, a pulse generator contains a divider and a frequency multiplier, whereby the divider is clocked at the input side with a basic clock of the basic frequency, and emits an output pulse sequence that has a frequency that is defined by the ratio of the basic frequency and a divider value determined by the comparison result. The frequency multiplier multiplies the frequency of the output pulse sequence by a whole-number value and outputs the control pulse sequence. By means of this measure, it is achieved that the positioning precision is increased, since in order to achieve an operating frequency range of the stepped motor that is e.g. co-determined by the transport means, higher divider values are required than without the use of a frequency multiplier. Given higher divider values, smaller frequency changes occur in the predetermined frequency operating range, despite the subsequent frequency multiplication per divider value step, i.e. an increasing or a lowering by one. Smaller frequency changes have the result that the stock is also offset only by small distances, so that a small offset can also be corrected.

In addition, the invention relates to a circuit arrangement for printing a print image on an endless stock in relation to a predetermined position in an electrographic printer, having a pulse generator for producing a pulse sequence of a predetermined frequency according to a predetermined value, having a stepped motor controlled by the pulse sequence of predetermined frequency, which motor drives a transport means that transports the stock past a transfer station, essentially according to a predetermined print speed, having a control unit for producing the print images that are printed successively on the stock at the transfer printing station with the print speed, having a signal pickup that scans the stock for markings that are present at regular intervals on the stock for the positioning of the print images in the direction of transport, whereby the signal pickup produces a marking signal when a marking is acquired, having a counter that starts a count process of clock signals, said process being started by means of a print image beginning signal that is produced by the control unit at the beginning of the printing of a print image, and which interrupts the count process upon the occurrence of the marking signal or after the occurrence of a fixed number of marking signals, whereby the control unit compares the count result with a target value, which corresponds to a counter state given offset-free positioning of the print images in relation to the markings, and whereby the control unit sets a predetermined value in the pulse generator dependent on the result of the comparison. The circuit arrangement serves to carry out the method according to the invention, so that the above-named effects are also transferred to the circuit arrangement.

BRIEF DESCRIPTION OF THE DRAWINGS

In the following, the invention is specified on the basis of embodiments.

DETAILED DESCRIPTION OF THE PREFERRED EMBODIMENTS

Figure 1:
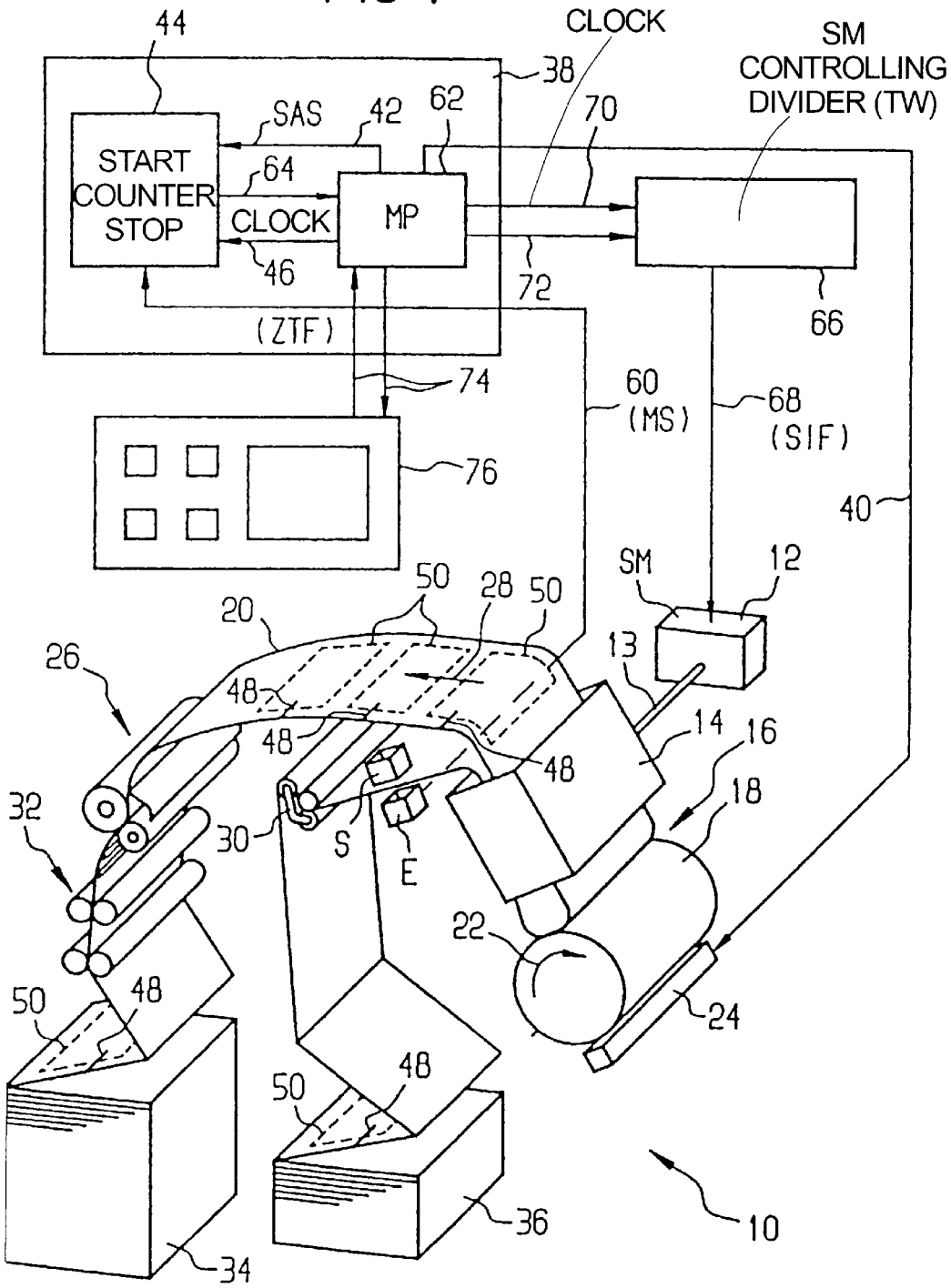
FIG. 1 shows a schematic view of an electrographic printer.

FIG. 1 shows a schematic view of an electrographic printer 10 and a block switching diagram of essential electrical functional units for driving a stepped motor 12. The printer 10 has a transport means 14 driven by the stepped motor 12 via a shaft 13, which transport means is arranged near a transfer printing station 16 and transports endless stock 20 past the transfer station 16, essentially according to a predetermined print speed VD. In the transfer printing station 16, a charge image that is applied on a photoconductor drum 18 and is colored in with toner is transferred onto the endless stock 20 by means of a corona means (not shown). The photoconductor drum 18 thereby rotates in the direction of the arrow 22. After the transfer printing, residual toner is removed and the surface of the photoconductor drum 18 rotates past an illumination row 24 that again illuminates the photoconductor drum 18.

After the stock 20 has been transported past the transfer station 16, it is supplied to a fixing station 26 in which the toner image, which is still susceptible to blurring, is sealed into the stock in blur-proof fashion, with the aid of pressure and temperature. In the direction of transport indicated by an arrow 28, seen before the transfer printing station 12, a first deflection unit 30 is arranged that guides the stock 20 to the transfer printing station 16. A second deflection unit 32 is arranged after the fixing station 26, seen in the direction of transport. This second deflection unit 32 stacks the printed stock 20 on a stack 34. At the beginning of the print process, the stock 20 is removed from a stack 36 by the first deflection unit 30. Instead of the two stacks 34 and 36, rollers are used on which the stock 20 is rolled.

The print process is controlled by a print control unit 38. The print control unit 38 produces the print images page-by-page, by transmitting the items of image information of a respective row to the illumination row via data lines 40. The print images are successively printed on the stock 20 at the transfer printing station 16 with the printing speed. At the beginning of the printing of a page, a page beginning signal SAS is thereby produced on a data line 42 by the print control unit 38, which signal enables a counter 44 that counts the impulses of a count clock sequence on a count clock line 46. The frequency of the count clock sequence ZTF is about 100 kHz.

On the stock 20 there are markings 48 at regular intervals, which were printed on the stock 20 by means of offset printing before the print process. The markings 48 were printed on the stock 20 simultaneously with pre-printed form material 50, and are arranged with a fixedly predetermined position in relation to the pre-printed form material 50.

Figure 2A:
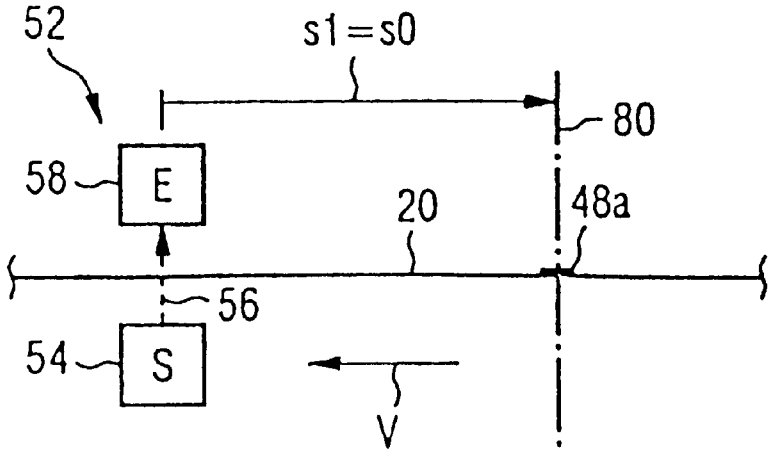
FIGS. 2*a*, 2*b* and 2*c* show three positional relationships between a sensor and a marking on the stock.

As shown in FIG. 2*a*, a photoelectric barrier 52 scans the stock 20 for the markings 48. The photoelectric barrier 52 contains a light transmitter 54 for emanating a light beam 56 and a light receiver 58 on which the light beam 56 impinges when none of the markings 48 is between the light transmitter 54 and the light receiver 58. The light receiver 58 contains a circuit that produces a marking signal MS upon detection of a marking, which signal is transmitted to the counter 44 on a signal line 60 and interrupts the count process in the counter 44.

In addition, the print control unit 38 contains a microprocessor 62 that reads out the count result from the counter 44 via data lines 64 after the termination of the count process, and compares it with a target value. The target value corresponds to a counter state given an offset-free positioning of the print images in relation to the markings 48. 'offset-free' means that letters contained in the print images are printed precisely in the fields provided therefor in the pre-printed form material 50.

If a deviation between the counter result and the target value is determined, the stepped motor 12, which is connected in rotationally fixed fashion with the transport means 14 via the shaft 13, is driven in such a way that it rotates faster or slower according to the direction of the deviation. The stepped motor 12 is driven by a current pulse sequence SIF that is produced. The current pulse sequence SIF is transmitted from the pulse generator 66 to the stepped motor 12 by a pulse generator 66 via a control line 68.

The pulse generator 66 is clocked at the input side with a basic clock signal that has a basic clock frequency of 10 MHz. The frequency of the current pulse sequence SIF stands in a ratio to the basic frequency that is determined by a whole-number divider value TW. The divider value TW is transmitted by the microprocessor 62 to the pulse generator 66 via data lines 72. At the beginning of the print process, the divider value TW is predetermined by the microprocessor 62 in such a way that the speed V of the stock 20 in the transport direction corresponds to the print speed VD. If during the print process differences occur between the speed V and the print speed VD, e.g. due to microslippage of a drive roller of the transport means 14 on the stock 20, the count result will differ from the target value. The divider value TW is increased by the microprocessor 62 if the speed V is greater than the print speed VD. The markings 48 are in this case pre-offset in the direction of transport 28, in relation to the print image. The divider value TW is reduced by the microprocessor 62 if the markings 48 in the direction of transport 28 are post-offset in relation to the print images.

The print control unit 38 is connected with an input/output apparatus 76 via data lines 74, via which lines the print speed VD can for example be predetermined by an operator.

Figure 2B:
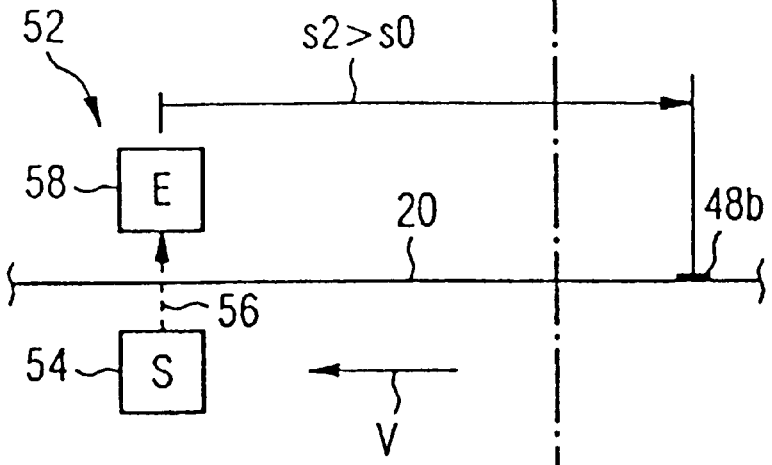
Figure 2C:
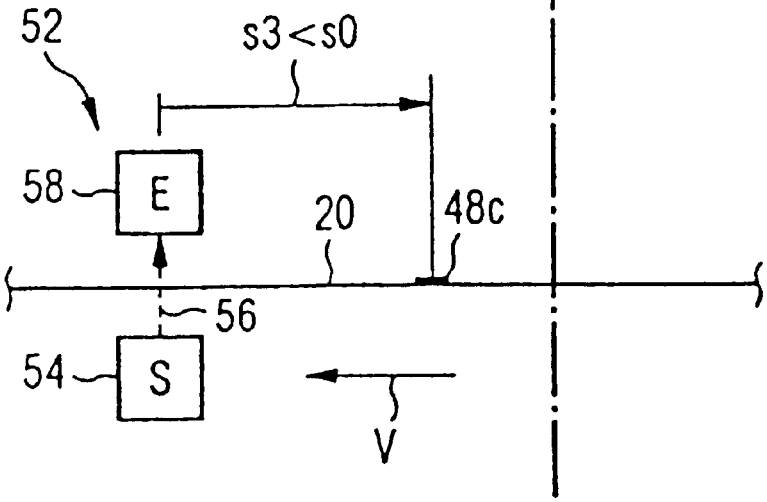

FIGS. 2*a*, 2*b* and 2*c* show three positional relationships between the photoelectric barrier 52 and the markings 48*a*, 48*b*, 48*c* that are applied to the stock 20. FIGS. 2*a*, 2*b* and 2*c* thereby respectively show momentary registrations that correspond to a position of the markings 48*a*, 48*b*, and 48*c* respectively at the beginning of the printing of a printed page, i.e. precisely at the moment at which the page beginning signal signals the beginning of a new printed page.

FIG. 2*a* shows a marking 48*a* that is spaced from the photoelectric barrier 52 by the distance s1 at the beginning of a new printed page. The momentary speed V of the stock 20 corresponds essentially to the print speed V. In practice, the momentary speed V deviates from the print speed VD only by a maximum of a few thousandths, so that the momentary speed V is regarded as constant in the determination of the distance between the marking 48*a* and the photoelectric barrier 52 at the time of a new page beginning.

If the counter 44 is started with the beginning of a new printed page and is interrupted when the mark 48*a* interrupts the light beam 56, the counter result corresponds to a time t1 that the marking 48*a* needs in order to run through the distance s1. The microprocessor can calculate the length of the distance s1 by multiplying the assumed momentary speed V by the time t1. In the case of the part a of FIG. 2, the microprocessor determines that the distance s1 corresponds precisely to a target distance s0 that ensures that the print images are oriented in relation to the markings 48. Specifically, the print image is also oriented close to the marking 48*a* in relation to this marking.

FIG. 2*b* shows the case in which at the time of the beginning of the printing of a page there is a distance S2 between a marking 48*b* and the photoelectric barrier 52. In FIG. 2*b*, the count result is higher than is the count result in FIG. 2*a*, since the assumed momentary speed V is regarded as constant, and a larger distance s2 is to be traveled. The microprocessor 22 calculates the distance s2 by multiplying the momentary speed V by a time t2 corresponding to the increased count result. The microprocessor 62 can thus determine that the distance s2 is greater than the target distance s0. The marking 48*b* is located, in the direction of transport, before a broken line 80 that represents an endpoint of the target distance s0. The other endpoint of the target distance s0 is the photoelectric barrier 52. The markings 48 run behind the print images. For correction, the microprocessor 62 will increase the divider value TW in the pulse generator 66.

FIG. 2*c* shows the case in which a distance s3 between a marking 48*c* and the photoelectric barrier 52 is smaller than the target distance s0 at the time of the beginning of the printing of a page. The marking 48*c* is located, in the direction of transport, behind the dotted line 80. In FIG. 2*c*, the count result in the counter 44 is lower than the target value. The microprocessor 62 determines the length of the distance s3 by, again, multiplying the assumed momentary speed V by the count result, which corresponds to a time t3. In FIG. 2*c*, the markings 48 run ahead of the print images. The marking 48*c* is thus pre-offset in relation to a print image to be printed in its vicinity in the direction of transport. For correction, the microprocessor 62 will reduce the divider value TW.

Figure 3A:
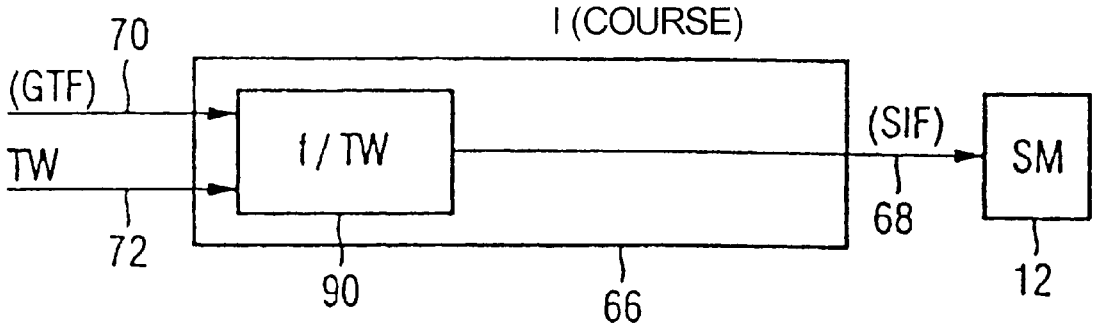
FIGS. 3*a*, 3*b* and 3*c* show three variants for producing a current pulse sequence for a stepped motor.
Figure 3B:
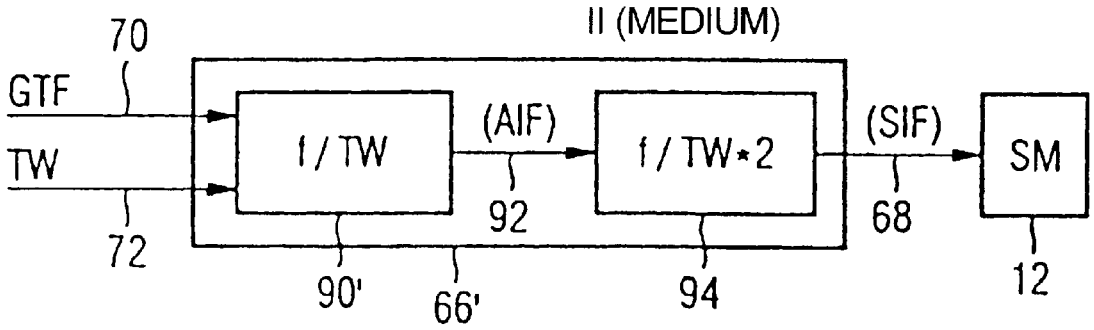
Figure 3C:
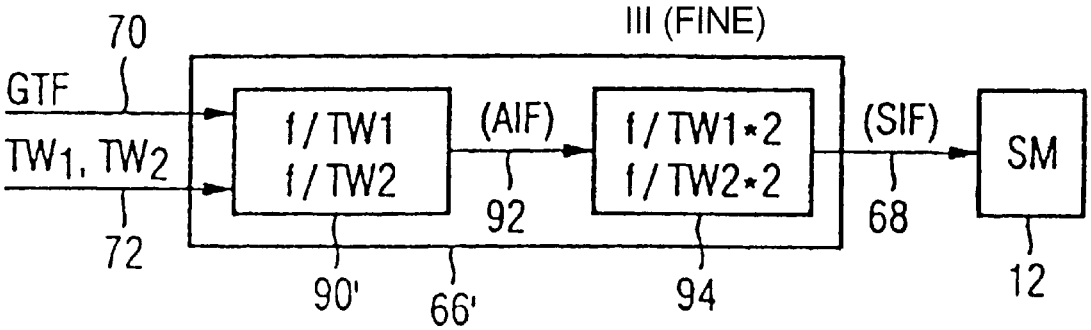

FIGS. 3*a*, 3*b* and 3*c* shows three variants I to III for producing the current pulse sequence SIF for the stepped motor 12 in the pulse generator 66.

FIG. 3*a* shows a first embodiment of the pulse generator 66. The pulse generator 66 contains a divider 90 that is clocked at the input side with the basic clock on the basic clock line 70, and in which the divider value TW is stored via the data lines 72. The output of the divider 90 is connected directly with the control line 68. The frequency of the current pulse sequence SIF is thus defined by the ratio of the basic frequency and the divider value TW.

FIG. 3*b* shows a second embodiment of a pulse generator 66' that is used instead of the pulse generator 66. The pulse generator 661 contains a divider 90' whose manner of functioning corresponds to that of the divider 90 already explained in FIG. 3*a*. An output pulse sequence AIF of the divider 90' is connected to a frequency doubler 94 via a data line 92 at the input side. The frequency doubler 94 doubles the frequency of the output pulse sequence AIF and produces the current pulse sequence SIF at the output side on the control line 68. As explained below on the basis of FIG. 4, the use of the pulse generator 66' leads to a more precise positioning of the stock 20 than with the use of the stock 66.

FIG. 3*c* shows a third variant III for producing the current pulse sequence SIF, in which the pulse generator 66' is used. For fine positioning, the time interval between two successive comparisons of the microprocessor 62 is divided into two time segments. In the first time segment, a divider value TW1 is stored in the divider 90', and in the second time interval a divider value TW2 is stored in the divider 90'. The manner of action of variant III is likewise explained in the following on the basis of FIG. 4.

Figure 4:
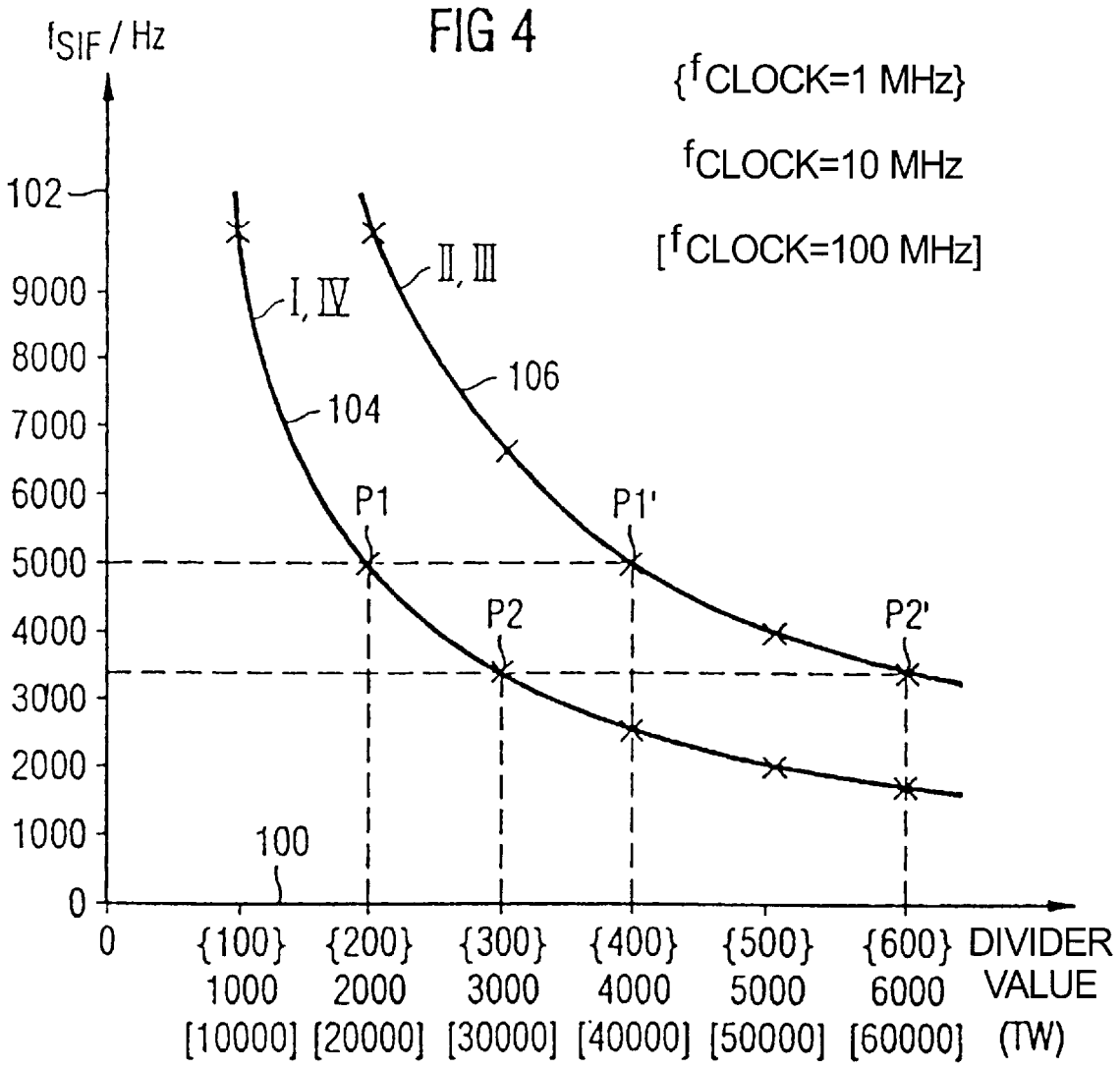
FIG. 4 shows a diagram for the representation of the relation between the divider value and the frequency of the current pulse sequence.

FIG. 4 shows, in a diagram, the dependence of the frequency of the current pulse sequence SIF on the magnitude of the divider value TW in the pulse generator 66 or, respectively, 66'. The divider value TW is plotted on the abscissa axis 100. Numbers in curved brackets thereby relate to a basic clock frequency of 1 MHz, numbers without brackets relate to a basic clock frequency of 10 MHz, and numbers in square brackets relate to a basic clock frequency of 100 MHz. The frequency of the current pulse sequence SIF is plotted in Hertz on the ordinate axis 102. A curve 104 represents the connection between the divider value TW and the frequency of the current pulse sequence SIF for the variant I. For example, given a basic clock frequency of 10 MHz and a divider value TW of 2000 at a point P1, the frequency of the current pulse sequence SIF is 5000 Hz. Since the divider value TW can assume only whole-number values, the curve 104 consists of a sequence of points. The higher the basic clock frequency, the more points are located between two predetermined points, e.g. P1 and P2 of the curve 104. In the embodiment, as already mentioned, a basic clock frequency of 10 MHz was selected. This represents a compromise between the circuit outlay and the spacing of two adjacent points on the curve 104.

In embodiment II of FIG. 3*b*, a curve 106 represents the relation between the divider value TW and the basic clock frequency. In embodiment II, the divider value for setting the same frequency of the current pulse sequence SIF has to be twice as high as in variant I. A divider value TW of 4000 and a frequency of the current pulse sequence SIF of 5000 Hz is allocated to a point P1'. A divider value TW of 6000 and a frequency of the current pulse sequence of 3333 Hz is allocated to a point P2'. Between the points P1' and P2', there are twice as many points on the curve 106 as between points P1 and P2 on the curve 104. Accordingly, the resolution of the curve 106 has doubled in relation to that of the curve 104. This means that with embodiment II smaller positional deviations can be corrected than with embodiment II, since e.g. an increase of the divider value TW by the value 1 results only in a slight change in the frequency of the current pulse sequence SIF, and the change connected therewith of the transport speed of the stock 20 leads only to a small offset of the stock 20.

The third embodiment III of FIG. 3*c* is based on the curve 106, but the resolution is further increased in relation to variant II, by attenuating the frequency jump—predetermined by the whole-number divider value TW—of the current pulse sequence SIF in that only an absolutely necessary part of the frequency jump becomes effective for the correction of the position of the markings 48 in relation to the print image. The design of embodiment III can of course also be used in a embodiment IV in the pulse generator 66.

Figure 5:
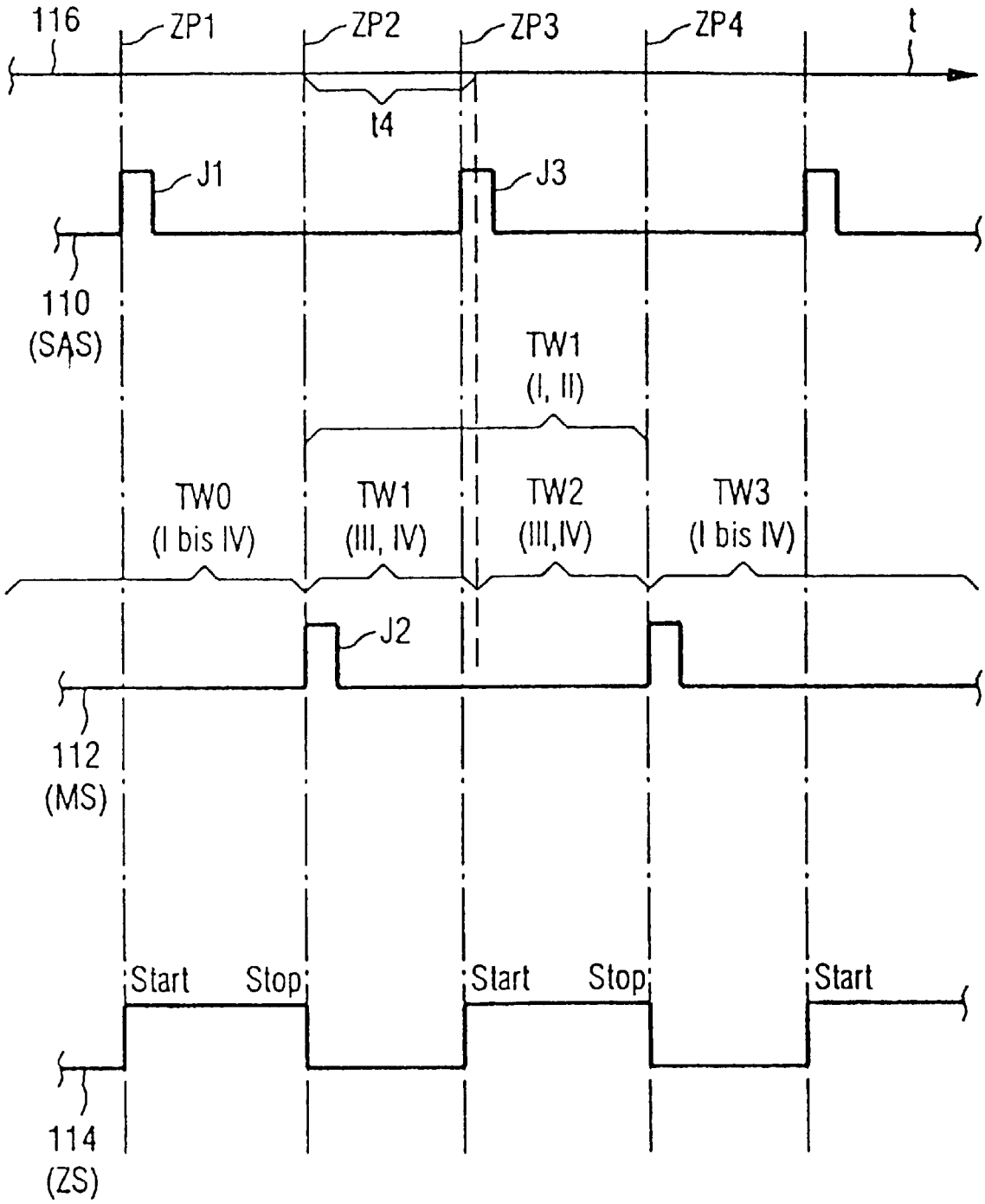
FIG. 5 shows time curves of a page beginning signal, of a marking signal and of a counter signal.

FIG. 5 shows a time curve 110 of the page beginning signal SAS, a time curve 112 of the marking signal MS and a time curve 114 of a count signal ZS. In addition, in FIG. 5 a part of a time ray 116 is shown that serves as a reference quantity for the time curves 110 to 114. At a time ZP1, the voltage value of the count signal ZS is increased by means of a voltage impulse I1 of the page beginning signal SAS, whereby the count process is started in the counter 44. At a time ZP2 at which a marking 48 passes the photoelectric barrier 52, by means of a voltage impulse I2 of the marking signal MS the count signal ZS is switched to a lower voltage value, whereby the count process in the counter 44 is stopped.

The microprocessor 62 determines a new divider value TW1 from the count result in the counter 44, according to the embodiments I, II, III, or IV, and stores it in the divider 90 or, respectively, 90', if it deviates from the divider value TW0. In embodiments III and IV, after a predetermined time t4 a divider value TW2 is stored in the divider 90'. At a time ZP3, a voltage impulse I3 of the page beginning signal SAS is produced by the print control unit 38, which, as described above, introduces a new count process. After termination of this count process, a divider value TW3 is stored in the counter 90 or, respectively, 90'.

Figure 6:
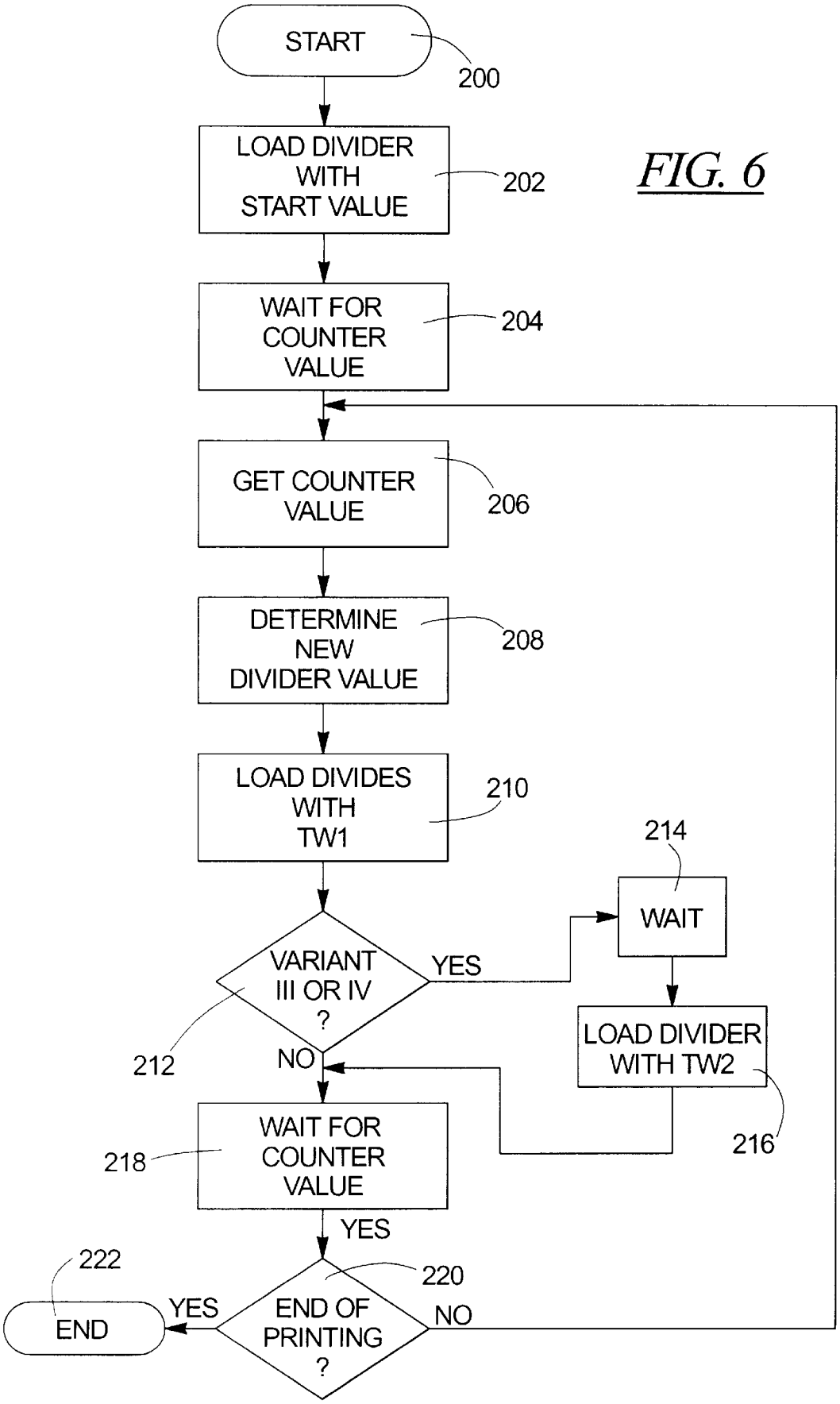
FIG. 6 shows a flow diagram of a method for the offset-free printing of the print images in relation to the markings.

FIG. 6 shows a flow diagram of the method for the offset-free printing of the print images in relation to the markings 48. The method begins in a step 200 with an initialization phase from steps 202 and 204. In step 202, the divider 90 or, respectively, 90' is initialized with a divider value TW that leads to a speed V of the stock 20 that corresponds approximately to the print speed VD. At the beginning of the print process, the stock 20 is oriented in the transport means 28 in such a way that the markings are oriented to an adjustment ruler, so that the first print images have no offset in relation to the markings 48. In step 204, the microprocessor 62 waits until a first count process in the counter 44 has terminated.

In a step 206, the microprocessor 62 reads the count result from the counter 44 and determines, in a step 208, a new divider value in the case of variants I and II, or, respectively, two new divider values in the case of embodiments III and IV. In step 210, the divider value TW1 is transmitted to the divider 90 or, respectively, 90' via the data lines 72.

In a step 212, the microprocessor 62 checks whether the embodiments III or IV are active. If this is not the case, the method continues in a step 218. If embodiments III or IV is active, the microprocessor 62 waits in a step 214 until a time calculated in the step 208 has passed, in order subsequently to transmit in a step 216 the second divider value TW2 to the divider 90 or, respectively, 90'. Subsequently, the method is continued in the step 218, in which the microprocessor 62 waits for a new count result. If a new count result is present, the microprocessor 62 checks in a method step 220 whether printing is to be terminated. If this is not the case, the method is continued in a loop of steps 206 to 220. If in step 220 the microprocessor determines that the printing is to be terminated, it terminates the process in a step 222.

Although other modifications and changes may be suggested by those skilled in the art, it is the intention of the inventors to embody within the patent warranted hereon all changes and modifications as reasonably and properly come within the scope of their contribution to the art.

What is claimed is:

1. A method for printing a print image on an endless stock in relation to a predetermined position in an electrographic printer, comprising the steps of:

using a stepped motor controlled by a current pulse sequence to drive a transport apparatus that drives the endless stock by one of friction and positively locked connection, said transport apparatus transports the endless stock past a transfer printing station according to a predetermined print speed, producing print images by a print control unit in a print process, successively printing on the endless stock at the transfer printing station with the print speed, producing a print image beginning signal at a beginning of printing of a print image by the print control unit, starting a count process of clock signals in a counter by said print image beginning signal, scanning the endless stock for markings that are present at regular intervals for positioning of the print images in a direction of transport, said scanning step producing a marking signal when a marking is detected, interrupting the count process upon one of occurrence of the marking signal and occurrence of a fixed number of marking signals, comparing a count result with a target value that corresponds to a counter state given offset-free positioning of the print images in relation to the markings, setting a frequency of a current pulse sequence dependent on a result of said comparing step including the frequency for the current pulse sequence by a pulse generator clocked with a basic frequency, said pulse generator outputting the current pulse sequence at an output side with a frequency related to the basic frequency by a whole number divider value, and defining the whole number divider value dependent on the result of said comparing step.

2. A method according to claim 1, further comprising the step of:

communicating at at least one location in positively locking fashion a forward movement in the direction of transport to the endless stock by the transport apparatus.

3. A method according to claim 2, wherein the pulse generator contains a divider that is clocked at an input side with a basic clock of the basic frequency, and further comprising the step of:

outputting the current pulse sequence with a frequency that is defined by a ratio of the basic frequency and a divider value.

4. A method according to claim 2, wherein the pulse generator contains a divider and a frequency multiplier, and further comprising the steps of:

clocking the divider at an input side with a basic clock of the basic frequency, and outputting an output impulse sequence that has a frequency that is defined by a ratio of the basic frequency and the divider value, wherein the frequency multiplier multiplies the frequency of the output impulse sequence by a whole-number value, preferably the value two, and wherein the frequency multiplier outputs the control impulse sequence.

5. A method according to claim 4, further comprising the steps of:

providing a fine positioning by dividing a time interval located between two successive comparisons into at least two time segments, and allocating a determined divider value to each of the time segments.

6. A method according to claim 1, further comprising the step of:

printing the markings on the endless stock before beginning of the printing process.

7. A circuit arrangement for printing a print image on an endless stock in relation to a predetermined position in an electrographic printer, comprising:

a pulse generator for producing a pulse sequence of a predetermined frequency according to a predetermined divider value, a stepped motor controlled by the pulse sequence of a predetermined frequency, a transfer station, a transport apparatus that is driven by the stepped motor to transport the endless stock past said transfer station according to a predetermined print speed, a control unit for producing the print images that are printed successively on the endless stock at the transfer printing station with the print speed, a signal pickup that scans the endless stock for markings that are present at regular intervals on the endless stock for the positioning of the print images in the direction of transport, wherein the signal pickup produces a marking signal when a marking is acquired, a counter that starts a count process of clock signals, said count process being started by a print image beginning signal that is produced by the control unit at the beginning of the printing of a print image, and which interrupts the count process upon one of occurrence of the marking signal and occurrence of a fixed number of marking signals, and wherein the control unit compares the count result with a target value, which corresponds to a counter state given offset-free positioning of the print images in relation to the markings, and wherein the control unit sets the predetermined divider value in the pulse generator dependent on the result of the comparison.

* * * * *